US007594551B1

(12) United States Patent
Mouton

(10) Patent No.: US 7,594,551 B1
(45) Date of Patent: Sep. 29, 2009

(54) DOWNHOLE SUPERCHARGER PROCESS

(76) Inventor: David E. Mouton, 3414 Beach Point Dr., Kingwood, TX (US) 77345

( * ) Notice: Subject to any disclaimer, the term of this patent is extended or adjusted under 35 U.S.C. 154(b) by 64 days.

(21) Appl. No.: 11/609,550

(22) Filed: Dec. 12, 2006

Related U.S. Application Data

(60) Provisional application No. 60/749,886, filed on Dec. 12, 2005.

(51) Int. Cl.
*E21B 41/00* (2006.01)
*E21B 21/08* (2006.01)
*E21B 4/00* (2006.01)

(52) U.S. Cl. ..... 175/57; 175/50; 175/424

(58) Field of Classification Search ..... 175/57, 175/65, 50, 237, 424
See application file for complete search history.

(56) References Cited

U.S. PATENT DOCUMENTS

| | | | | | |
|---|---|---|---|---|---|
| 3,550,696 | A | * | 12/1970 | Kenneday | 175/25 |
| 3,724,576 | A | | 4/1973 | Roberts | |
| 4,577,614 | A | * | 3/1986 | Schoeffler | 175/25 |
| 4,633,958 | A | * | 1/1987 | Mouton | 175/65 |
| 4,844,183 | A | | 7/1989 | Evans | |
| 4,846,273 | A | | 7/1989 | Anderson et al. | |
| 5,232,060 | A | | 8/1993 | Evans | |
| 5,233,866 | A | * | 8/1993 | Desbrandes | 73/152.05 |
| 5,425,430 | A | | 6/1995 | Roberts | |
| 5,431,221 | A | | 7/1995 | Roberts et al. | |
| 5,432,446 | A | * | 7/1995 | MacInnis et al. | 324/303 |
| 5,503,228 | A | | 4/1996 | Anderson | |
| 5,584,353 | A | | 12/1996 | Chancey et al. | |
| 5,918,688 | A | | 7/1999 | Evans | |
| 5,969,241 | A | * | 10/1999 | Auzerais | 73/152.16 |
| 6,290,004 | B1 | | 9/2001 | Evans | |
| 7,066,263 | B1 | | 6/2006 | Mouton | |
| 2006/0180754 | A1 | * | 8/2006 | Edwards et al. | 250/269.3 |

* cited by examiner

*Primary Examiner*—Shane Bomar
(74) *Attorney, Agent, or Firm*—Garvey, Smith, Nehrbass & North, L.L.C.; Gregory C. Smith

(57) ABSTRACT

A method and apparatus to stop the influx of down hole fluids while drilling utilizing the downhole Supercharger Process including the steps of providing a down hole fluid supercharger tool in he drilling operation; detecting permeable zones at the surface while drilling utilizing the down hole supercharger process; locking the tool into a standard, continuous (non-intermittent) drilling mode; and resuming the supercharger process after the permeable zone has been penetrated. The invention also includes an method that detects permeable zones while utilizing the down hole supercharger process by monitoring pressure fluctuations at the surface, and an apparatus that controls the operation of the down hole supercharger from supercharger cycle to a conventional drilling mode by varying the compression on the tool (weight on bit).

1 Claim, 2 Drawing Sheets

DOWNHOLE SUPERCHARGER PROCESS

CROSS-REFERENCE TO RELATED APPLICATIONS

Priority of U.S. Provisional Patent Application Ser. No. 60/749,886, filed Dec. 12, 2005, incorporated herein by reference, is hereby claimed.

This process is related to U.S. Pat. No. 4,633,958 entitled, "Downhole Fluid Supercharger", which is incorporated in its entirety by reference thereto.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved process in drilling for hydrocarbons, whereby permeable zones are detected as soon as they are penetrated, using the Supercharger Process, and whereby the Supercharger Tool is actuated into a conventional drilling mode to stop the potential influx of down hole fluids. After the permeable zone has been penetrated, the invention allows the tool to be converted back to the Supercharger process to allow further increases in rate of penetration.

2. General Background of the Invention

U.S. Pat. No. 4,633,958 ('958 patent), entitled "Downhole Fluid Supercharger," which is incorporated by reference herein, describes a process whereby high velocity (supercharged) streams of drilling fluid are directed upward on an intermittent basis to increase rates of penetration in drilling operations. These penetration rates are increased because hydrostatic pressure acting on the bottom of the hole is intermittently reduced due to the resultant low pressure of the high velocity streams.

The Supercharger Process can be accurately described as claim 20 in the '958 patent as the method described as follows: ". . . wherein the steps of interrupting and resuming the fluid flow to said drill bit are repeated during cyclical rotations of said drill string . . ."

It should be mentioned for clarity that "interrupting and resuming the fluid flow to said drill bit" as described in the '958 Patent consists of two parts, the "functioning of the apparatus between the first position for jetting and diffusing exterior to the apparatus and a second position to blocking such jetting and diffusing and allowing fluid flow to the bit". Typically the first cycle (jetting and diffusion) is called the Supercharger Cycle, and the second position (flow to the bit) is called the Drilling Cycle.

As described in the '958 Patent, it is imperative that the Supercharger Cycle is regularly interrupted by the Drilling Cycle in order to remove cuttings generated by the drill bit from below the tool to above tool. If this is not done on a cyclical basis, cuttings will build up below the tool and ultimately cause the tool to get stuck in the hole, as the Supercharger Cycle effectively blocks the annulus between the tool and borehole wall to enable pressure reduction at the bit, which disallows the passage of cuttings. The Drilling Cycle allows unobstructed passage of cuttings around the tool, with fluid flow exiting the bit in a conventional manner.

The '958 Patent describes an apparatus that continuously cycles in a three to one rotation of the drillstring from the Supercharger Cycle to the Drilling Cycle; hereinafter called the Supercharger Tool; however, no provisions were made to be able to detect permeable zones, and lock the tool into a continuous, conventional Drilling Cycle so that permeable zones can be safely penetrated without allowing an influx into the well.

A decrease in pressure and corresponding increase in drilling rates are well documented. A technique called Under Balanced Drilling is widely used in industry to exploit the efficiency of low pressure drilling. This technique lowers the entire pressure throughout the well bore by utilizing low density fluids and capping the top of the well with a sealing rotating device called a "rotating head". This device contains hydrocarbons that may enter the well bore due to the lowered pressure, thereby preventing an uncontrolled flow or "blowout". Separation equipment is installed on the surface and removes hydrocarbons from the drilling fluid as well as utilizing a combustible flare to dispose of these potentially dangerous substances.

It should be mentioned that the above technique is employed in "tight" formations such that the magnitude of influxes is relatively small. In high permeability formation, such as encountered offshore, the Under Balanced Drilling technique is not generally utilized due to safety concerns.

It will be shown that such extraneous equipment and associated dangers are not required to achieve the same results of increased rates of penetration with the present invention, particularly in offshore operations where high permeable formations are routinely encountered.

U.S. Pat. No. 4,633,958 does not address the potential of hydrocarbons entering the well bore below the tool due to the lowered pressure below the tool that is allowed on an intermittent basis. Therefore, the method described in the Patent does not provide a safe means of utilizing the Supercharger Process; if a permeable, hydrocarbon-bearing zone is penetrated with the tool, hydrocarbons can enter the well bore, resulting in a "well control" situation, whereby time-consuming and relatively dangerous techniques are required to seal the well, circulate the influx of hydrocarbons and remove them from the drilling fluid.

BRIEF SUMMARY OF THE INVENTION

The present invention solves the problems in the art in a simple and straightforward manner. What is provided is a method and apparatus to stop the influx of potential downhole fluids from down hole while drilling with the Supercharger Process. These include the steps of providing a down hole fluid Supercharger Tool in the drilling operation; detecting permeable zones at the surface while drilling utilizing the down hole Supercharger Process; actuating the tool into a standard continuous (non-intermittent) drilling mode thereby interrupting the Supercharger Process; and resuming the Supercharger Process after the permeable zone has been penetrated. The invention also includes a method that detects permeable zones while utilizing the down hole supercharger process by monitoring pressure fluctuations at the surface via the hydraulic conduit of the drilling fluid contained inside the drill string, and an apparatus that controls the operation of the down hole supercharger from the cyclical Supercharger Process to a conventional, continuous non-intermittent drilling mode by varying the compression on the tool (weight on bit).

In the process of the present invention, an improved process is proposed whereby, during drilling for hydrocarbons, permeable zones are detected as they are penetrated. It is proposed to actuate the Supercharger tool, as disclosed in the '958 patent into a standard, continuous (non-intermittent) drilling process to stop the influx.

This is accomplished by monitoring pressure at the surface. If fluctuations are noted, it will be due to an influx from the permeable zone, which affects the "pressure recovery" or diffusion of the high velocity streams. With the present invention, the operator will note the increase of pressure at the surface due to the above-described deleterious effect of the diffusion or pressure recovery.

In essence, when more fluid is forced into the geometric-sensitive system of the Supercharger, the pressure will increase. This resultant pressure is then transmitted back to the surface at approximately 3500-4500- ft/sec via the hydraulic conduit of the drilling fluid inside the drilling string for detection. The operator than raises the tool, which lowers the compression on the tool (weight on bit). This action results in the tool locking into a standard, continuous drilling mode, whereby the intermittent pressure reductions are stopped. The permeable zone is then drilled in a conventional manner until drill cuttings at the surface indicate that impermeable formations are now being drilled. Then, by applying additional compression to the tool (weight-on-bit), the tool is unlocked and intermittent pressure reductions to the bottom of the hole are applied, (Supercharger Cycle) increasing drilling rates.

It should be mentioned that the bulk of deeper drilling where the Supercharger has the most potential to improve drilling operations consists of impermeable shales.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

U.S. Pat. No. 4,633,958 discloses an apparatus for directing "supercharged," i.e., high velocity streams of drilling fluid upward around a reduced area between the apparatus and the borehole. These high velocity "supercharged" streams, by virtue of the Bernoulli effect become very low in static fluid pressure. These high velocity, low pressure streams decrease the hydrostatic pressure at the drill bit and accomplish a more efficient drilling by the bit. What is provided is a main tool body positioned along the drill string intermediate a section of drill pipe and the drill bit. The Tool further comprises lower an external body portion which is rotated at a rotational velocity three times slower than the rotation of the velocity of the drill string. There is further provided a fluid jetting and diffuser system allowing the fluid or a portion of the fluid to be jetted out of the wall of the sub at a high velocity exterior to the sub in a reduced area between the sub and wall of the borehole whereby hydrostatic pressure is isolated and the pressure is reduced in that area around the drill bit thus reducing the hydrostatic pressure around the bit, for more efficient drilling. Upon further rotation of the external body portion, a porting system interrupts fluid flow to diffuser ports and allows flow back down into the drill bit area for the necessary washing away of the cuttings as the bit drills into the earth. Simultaneously, the reduced annular area is enlarged, allowing unobstructed passage of drill cuttings.

Figure 1:
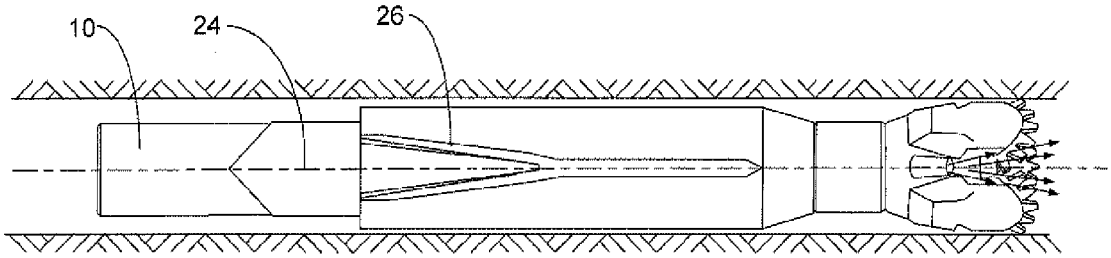
FIG. 1 illustrates an exterior view of the drilling cycle of the tool of the present invention.
Figure 4:
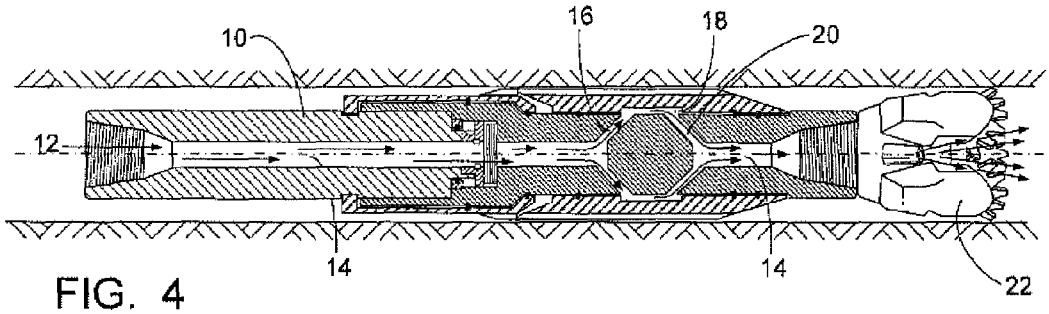
FIG. 4 illustrates a cross-section of the tool of the present invention in the Drilling Cycle.

In FIGS. 1 and 4, the tool 10 is seen in the drilling position. Drilling fluid 12 is circulated down the central bore 14 and exits through the drilling passages 16. The mud enters the drilling ports 18 and exits the port through the return passages 20 to the central bore 14. The fluid then exits the tool through the drill bit 22. Note that the stabilizers 24 and diffusers 26 are lined up in the exterior view (FIG. 1), permitting unobstructed passage of the cuttings.

Figure 2:
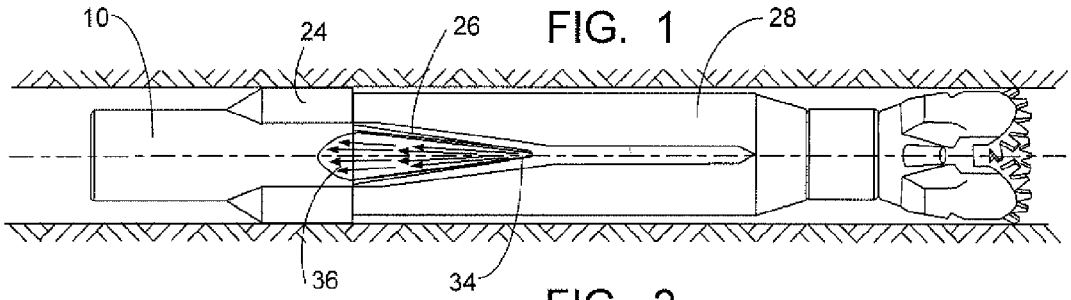
FIG. 2 illustrates an exterior view of the Supercharge Cycle of the present invention.
Figure 5:
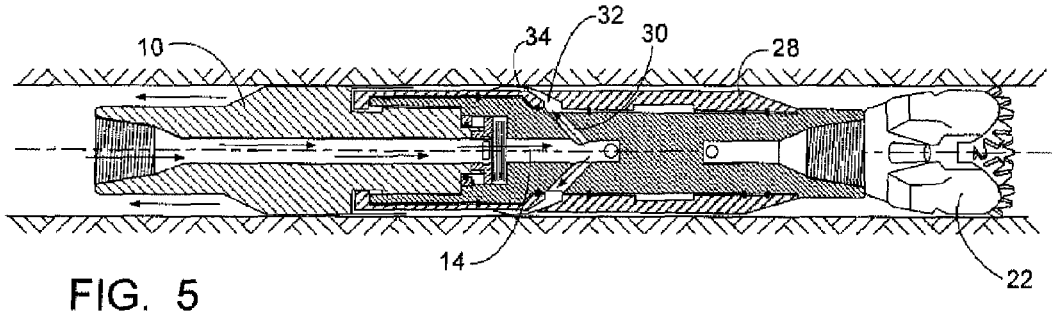
FIG. 5 illustrates a cross-section of the tool of the present invention in the Supercharger Cycle.

As seen in FIGS. 2 and 5, the tool 10 is seen in the supercharged position. The drill bit 22 has made one-half revolution, closing the flows from the drilling passages 16 to the drilling ports 18. The porting sleeve 28 has remained stationary due to friction against the side of the hole. Mud exits the central bore 14 through the jetting passages 30 and enters the jetting ports 32. Fluid is then ejected out of the jets 34 at high velocity, pushing the hydrostatic pressure upward 36. Note that the stabilizer blades 24 and diffusers 26 are misaligned in the exterior view, isolating the annular hydrostatic pressure. During each half rotation of the bit, the tool 10 alternates between the drilling and supercharged positions, as per the Supercharger Cycle as previously described from the '958 Patent.

Figure 3:
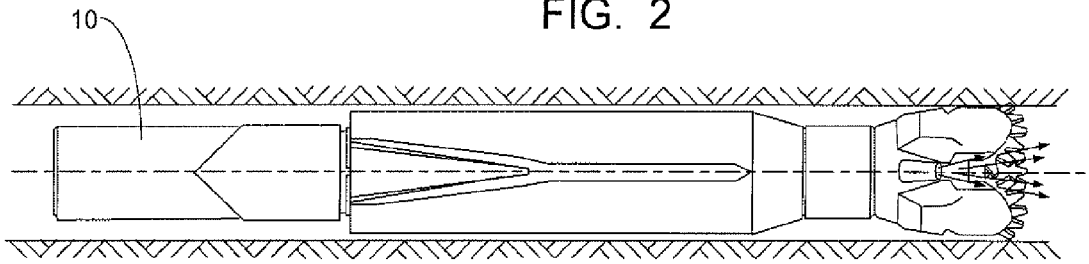
FIG. 3 illustrates an exterior view of the locked drilling (non-intermittent) position of the tool of the present invention.
Figure 6:
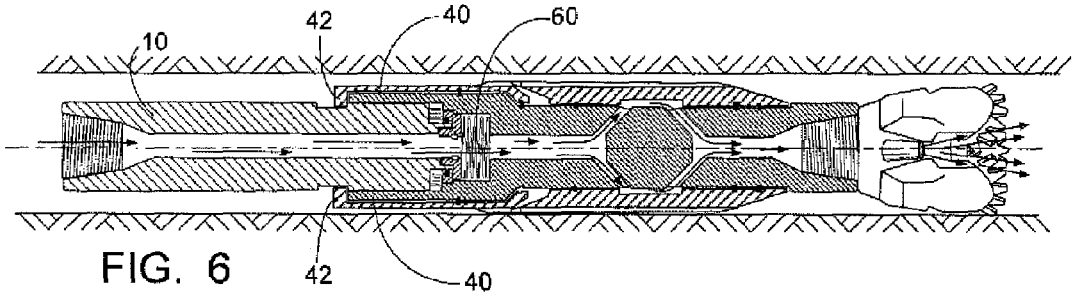
FIG. 6 illustrates a cross-section of the tool of the present invention in a locket drilling (non-intermittent) position.

As seen in FIGS. 3 and 6, the tool 10 is seen in the locked drilling (continuous non-intermittent) position. When the tool 10 is picked up off bottom, a belleville spring 60 provides a separating force that moves the tool along the splined shafts 40. This allows the tool to lock in a straight drilling-type position due to the locking lugs 42. This provides an on-demand mechanism that allows the tool 10 to operate in a normal drilling mode, with bit weights up to 25,000 lbs. (nominal value). By applying more than 25,000 lbs. the tool closes, by virtue of the contraction of belleville spring 60, thereby releasing the locking mechanism and allows the cyclical Supercharge Cycle to re-commence.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method to stop the upward influx of down hole fluid from down hole during a down hole drilling operation utilizing a supercharger process, whereby permeable zones are detected as soon as they are penetrated during the drilling operation, and whereby a downhole fluid supercharger tool that detects permeable zones while utilizing the down hole supercharger process by monitoring pressure fluctuations at the surface is actuated into the drilling cycle immediately, the method comprising the following steps:

a. providing the down hole fluid supercharger tool in the drilling operation;

b. detecting permeable zones at the surface while drilling, utilizing the down hole supercharger process;

c. locking the down hole fluid supercharger tool into a standard drilling cycle to interrupt the supercharger process; and d. resuming the supercharger process.

* * * * *